US012780577B2

(12) United States Patent
Andresen

(10) Patent No.: US 12,780,577 B2
(45) Date of Patent: Nov. 3, 2026

(54) GRIPPER HEAD AND A METHOD OF OPERATING A GRIPPER HEAD

(71) Applicant: Inwatec APS, Odense SV (DK)

(72) Inventor: Mads Andresen, Odense SV (DK)

(73) Assignee: INWATEC APS, Odense Sv (DK)

( * ) Notice: Subject to any disclaimer, the term of this patent is extended or adjusted under 35 U.S.C. 154(b) by 814 days.

(21) Appl. No.: 18/253,233

(22) PCT Filed: Nov. 25, 2021

(86) PCT No.: PCT/EP2021/082926
§ 371 (c)(1),
(2) Date: May 17, 2023

(87) PCT Pub. No.: WO2022/112383
PCT Pub. Date: Jun. 2, 2022

(65) Prior Publication Data

US 2024/0017946 A1 Jan. 18, 2024

(30) Foreign Application Priority Data

Nov. 25, 2020 (DK) ..... PA202070785

(51) Int. Cl.
*B65H 5/14* (2006.01)

(52) U.S. Cl.
CPC ..... *B65H 5/14* (2013.01); *B65H 2405/574* (2013.01); *B65H 2405/582* (2013.01); *B65H 2701/174* (2013.01)

(58) Field of Classification Search
CPC ... A41H 43/02; B25J 15/0004; B25J 15/0028; B25J 15/08; B25J 15/083; B25J 15/086;
(Continued)

(56) References Cited

U.S. PATENT DOCUMENTS 5,303,910 A 4/1994 McGill et al.
8,733,810 B2 5/2014 Oda
(Continued)

FOREIGN PATENT DOCUMENTS

CN 211225449 U * 8/2020
JP 2014-24143 A 2/2014
(Continued)

OTHER PUBLICATIONS

Search report dated May 19, 2021 (7 pages) out of Danish Priority Application PA 2020 70785.
(Continued)

*Primary Examiner* — Joshua E Rodden
(74) *Attorney, Agent, or Firm* — Crowell & Moring LLP

(57) ABSTRACT

A gripper head adapted to grip, hold and release a piece of cloth, including a first part and a second part with respective conveyor belts, an actuator, such as a hydraulic actuator, a pneumatic actuator or a motor, connected with the second part and configured for turning the second part relative to the first part to apply in a cloth nipping position a first clamping force on a piece of cloth, and a controller connected with the actuator and configured to control the actuator for the second part to selectively apply in a cloth nipping position a second, higher clamping force when the conveyor belts are temporarily stopped with a nipping zone filled by a portion of the piece of cloth.

18 Claims, 3 Drawing Sheets

(58) Field of Classification Search
CPC ... B65H 1/04; B65H 3/00; B65H 5/08; B65H 5/085; B65H 5/10; B65H 5/12; B65H 5/14; B65H 2405/57; B65H 2405/571; B65H 2405/572; B65H 2405/574; B65H 2405/575; B65H 2405/58; B65H 2405/581; B65H 2405/5812; B65H 2405/582; B65H 2701/174; B65H 2701/1742; B66C 1/48
USPC ..... 294/213
See application file for complete search history.

(56) References Cited

U.S. PATENT DOCUMENTS

| | | | | |
|---|---|---|---|---|
| 2002/0125727 | A1 | 9/2002 | Kazerooni et al. | |
| 2014/0028040 | A1 | 1/2014 | Oda | |
| 2020/0070358 | A1 | 3/2020 | Mousavi et al. | |
| 2021/0078184 | A1 * | 3/2021 | Andresen | B25J 15/00 |
| 2023/0311340 | A1 * | 10/2023 | Chawla | B25J 13/082 294/106 |

FOREIGN PATENT DOCUMENTS

| | | | | |
|---|---|---|---|---|
| SU | 1493575 | A1 | 7/1989 | |
| WO | WO 94/27900 | A1 | 12/1994 | |
| WO | WO 99/14420 | A1 | 3/1999 | |
| WO | WO-2019137585 | A1 * | 7/2019 | B65H 5/14 |
| WO | WO-2025078365 | A1 * | 4/2025 | B65H 29/00 |

OTHER PUBLICATIONS

International Search Report (4 pages) dated Mar. 28, 2022 out of PCT Priority Application PCT/EP2021/08292.
Written Opinion (4 pages) dated Mar. 28, 2022 out of PCT Priority Application PCT/EP2021/08292.

* cited by examiner

GRIPPER HEAD AND A METHOD OF OPERATING A GRIPPER HEAD

CROSS-REFERENCE TO RELATED APPLICATIONS

This application is a National Stage application of International Application No. PCT/EP2021/082926, filed Nov. 25, 2021, the entire contents of which are incorporated herein by reference.

This application claims priority under 35 U.S.C. § 119 (a) to Danish Patent Application No. PA202070785, filed on Nov. 25, 2020, the entire contents of each of which are incorporated herein by reference.

BACKGROUND OF THE INVENTION

Technical Field

The present invention relates to a gripper including an improved gripper head adapted to grip, hold and release a piece of cloth, in particular for use in industrial laundries where individual pieces of cloth need to be picked up and pulled away from a pile of several pieces of cloth.

Description of the Related Art

WO2019/137585 discloses in FIGS. 14-15 a gripper head including a pair of opposite conveyor belts. Between the two conveyor belts, where they face each other, is defined an elongated cloth nipping zone. A spring acts to turn and bias one of the two conveyor belts towards a cloth nipping position, allowing a piece of cloth to be held in the cloth nipping zone, sandwiched between the two conveyor belts.

A gripper with such a gripper head may preferably include a robotic arm having the gripper head mounted to its end. Such grippers are adapted to move the gripper head between a receiving position with the conveyor belts in contact with a piece of cloth to be picked up, and a delivery position wherein the picked up piece cloth is delivered to, e.g., a conveyor or another gripper. An example of a robotic arm with a gripper head is shown in FIG. 1 of WO2019/137585.

With the prior art gripper head, receiving a piece of cloth is done by activating the conveyor belts to move in one direction when the gripper head is in a receiving position, such that a portion of a piece of cloth in contact with the conveyor belts is drawn into the nipping zone by friction, out of the pile of pieces of cloth. When the nipping zone has been filled along its length, the conveyor belts are stopped and held still, and the gripper head is moved away from the pile, with the portion of the piece of cloth held sandwiched between the conveyor belts by the clamping force, towards the delivery position. In the delivery position the conveyor belts are activated to move in a reverse direction, to thereby release the piece of cloth from the nipping zone.

The spring providing the aforementioned clamping force must be selected to reduce or eliminate the risk that that the piece of cloth is dropped from the gripper head as it is drawn out of the pile and moved towards the delivery position. Sensors mounted to the gripper head may preferably be used to determine when the nipping zone is filled, such that the clamping force applied by the spring results in a relatively low clamping pressure applied onto the piece of cloth along the length of the nipping zone.

Another example of a gripper head for gripping, holding and releasing a piece of cloth is disclosed in WO94/27900.

In industrial laundries there is a need to be able to use a gripper head of the aforementioned type for processing batches of cloth made from delicate materials, such as silk, without leaving clamping marks, as well as for processing batches of large and/or heavy pieces of cloth. Hence, the present invention aims at providing an improved gripper head, and a method of operating a gripper head, whereby problems associated with processing by the one and same gripper head of pieces of cloth of different materials and weight are eliminated at least to some extent.

SUMMARY OF THE INVENTION

According to a second aspect of the invention, a method of operating a gripper head that involves the step of activating actuator of the gripper head to selectively apply a first clamping force on a piece of cloth in the nipping zone and/or to apply a second, higher clamping force on the piece of cloth in the nipping zone.

It is noted that the invention may be used in connection with many types of pieces of cloth, such as one or more of the following: Textiles, Garment, Towels, Sheets, Pillow cases, Bed sheets, Table cloth, Rags, Kitchen towel, Mops, Dust mats, Work wear, Gowns, Uniforms, Shirt, Socks, Private garment, Industrial workwear, Healthcare workwear, Food industry workwear, Infant textiles, Bibs, Blankets, Napkins, Wash glove and other flexibles in individual pieces. Whenever the term "cloth" is used in the following, one of the above or an element of similar nature is to be understood.

DETAILED DESCRIPTION

The invention will now be explained in more details by reference to two embodiments.

Figure 1:
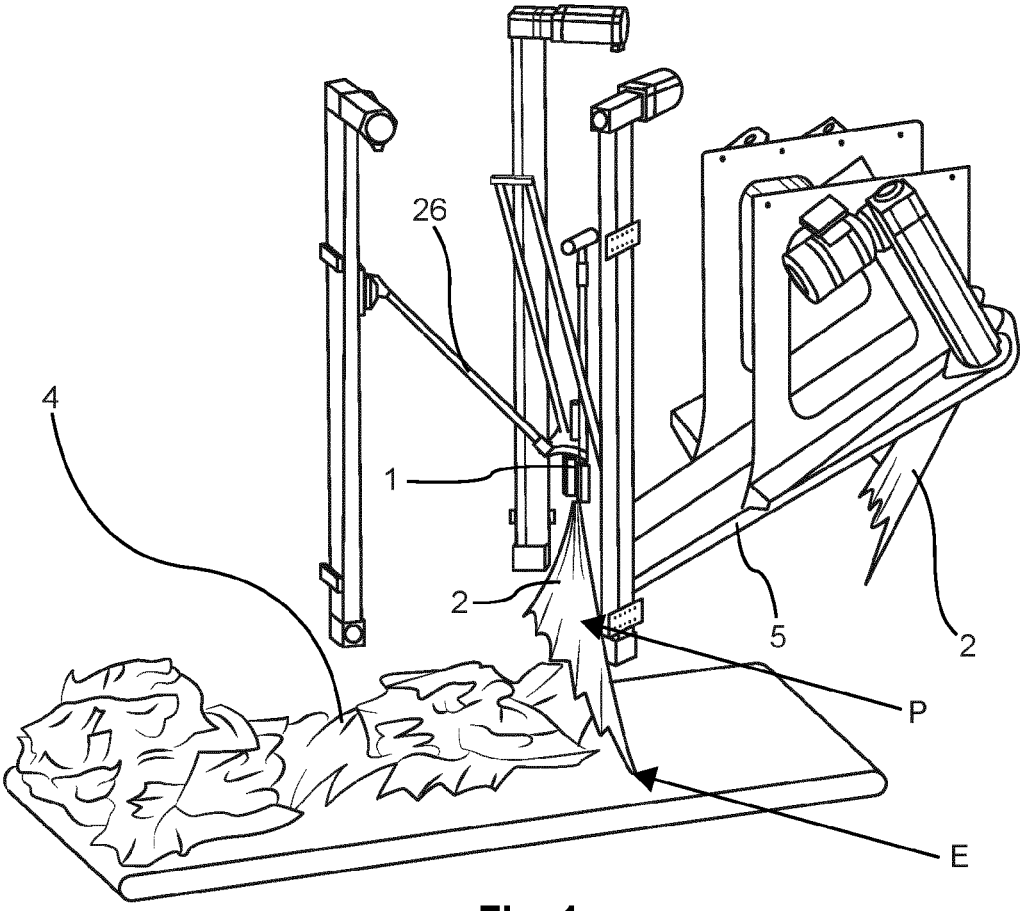
FIG. 1 shows an embodiment of a gripper with a gripper head in accordance with the present invention, in the environment in which it is intended to work.

FIG. 1 shows a gripper with a robotic arm 26 carrying a gripper head 1, in the process of transferring a piece of cloth 2 from a pile 4 of similar pieces of cloth to a conveyor or to another gripper 5, with the gripper head 1 holding on to a portion of the piece of cloth 2.

Where large size pieces of cloth 2, such as linen, are processed it may be desirable to raise the gripper head 1 by the robotic arm 26 to such an elevated position that a part P of the piece of cloth 2 located around halfway, or somewhere +/−10% halfway, between the portion held by the gripper head 1 and the end E of the suspended piece of cloth 2, may be gripped by a gripper head of the gripper 5. This may be done by first determining the size of the piece of cloth 2 held by the gripper head 1 or to be held by the gripper head 1, and then moving the robotic arm 26 with the piece of cloth 2 to an elevated position above the gripper 5 to which the piece of cloth 2 is to be transferred, with the elevated position being higher above the pile 4 for large pieces of cloth 2 than for smaller pieces of cloth 2. A controller (not shown) may determine the size using, by way of example, a camera, or the determination may be made visually or otherwise by an operator on a batch-by-batch basis or in respect to each piece of cloth 2 of a batch lying in the pile 4. In this way large size pieces of cloth are conveyed onwards by the gripper 5 in a folded form, thereby reducing the length of the tail of the piece of cloth 2 from where it is held by the gripper 5.

Figure 2A:
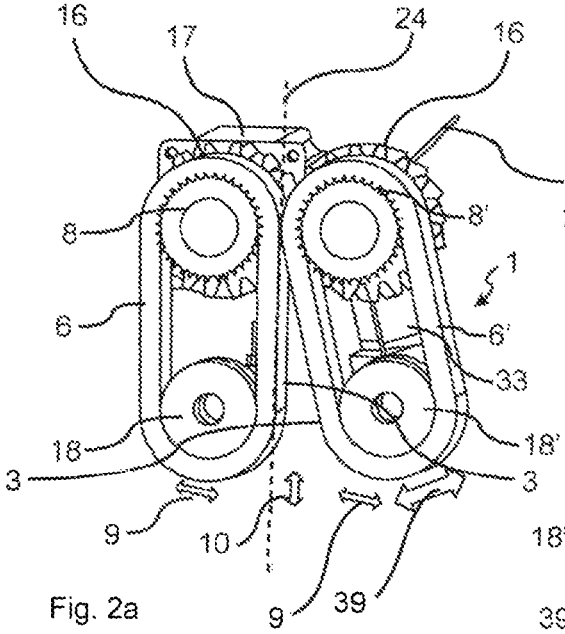
FIG. 2*a* is a front view showing an embodiment of a gripper head of the present invention, without a housing, an actuator arranged in the gripper head not being shown.
Figure 2C:
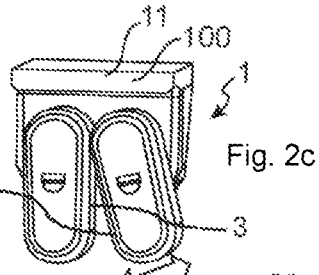
FIG. 2*c* is a front view of the embodiment of the gripper head of FIG. 2*a* with a housing, an actuator arranged in the gripper head not being shown.
Figure 2B:
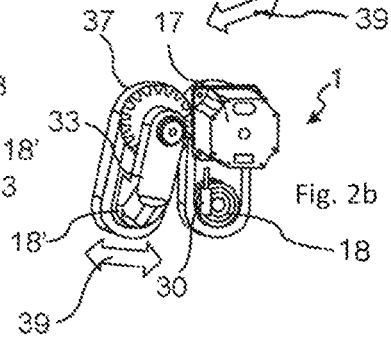
FIG. 2*b* is a rear view of the embodiment of the gripper head of FIG. 2*a* without a housing, an actuator arranged in the gripper head not being shown.

FIGS. 2*a-c* shows a gripper head 1 of the present invention, with a first part 11 that may be mounted to the end of a robotic arm, such as a robotic arm 26 for moving the gripper head 1 around in a 3-dimensional space as shown in FIG. 1.

FIGS. 2*a-c* corresponds to FIG. 14 of WO19137585, but the shown gripper head 1 in addition includes an actuator (not seen in FIGS. 2*a-c*) arranged inside the first part 11 and for the purpose to be discussed below.

Generally, the first part 11 carries two opposed conveyor belts 6, 6' defining between them, i.e. where they face each other, a nipping zone Z (see FIG. 3*a*) into which a piece of cloth 2 in contact with the conveyor belts 6, 6' may be drawn by friction when the conveyor belts 6, 6'—having been dipped into a pile 4 of pieces of cloth 2—move in a first direction. As shown, a first one 6 of the two conveyor belts 6, 6' is a loop trailed around a first pair of rollers 8, 18 and a second one 6' of the conveyor belts is a loop trailed about a second pair of rollers 8', 18'. A drive, preferably in the form of a motor 17, is configured for moving the opposite faces of the two conveyor belts 6, 6' in the first, upwards direction, to then stop moving the conveyor belts 6, 6'—and hold them—when the nipping zone Z is filled by the portion of the piece of cloth 2, and for then moving the opposite faces of the two conveyor belts 6, 6' in an opposite downwards direction to release the piece of cloth 2 from the nipping zone Z.

Figure 2D:
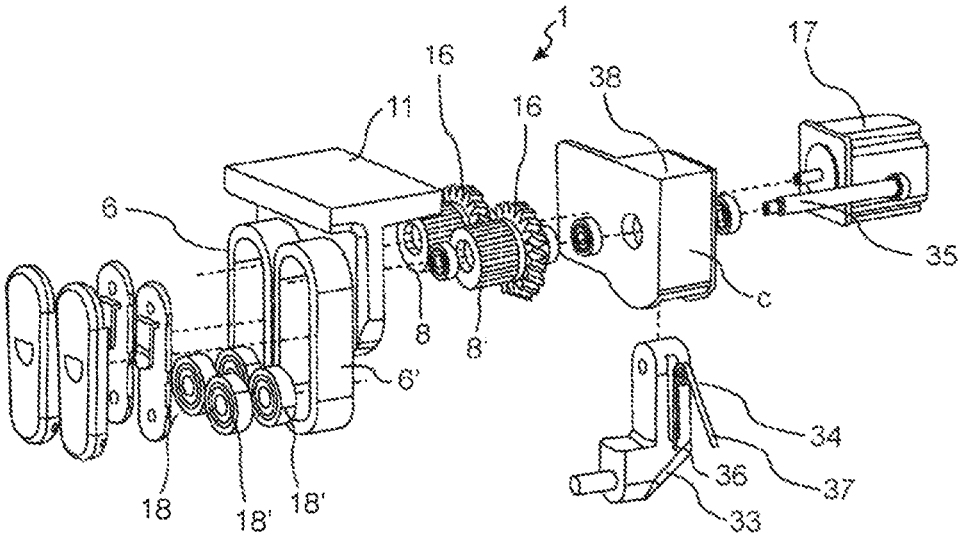
FIG. 2*d* shows an exploded view of a second embodiment of a gripper head of the invention, similar to the gripper head shown in FIG. 2*a*, including a spring, an actuator arranged in the gripper head not being shown.
Figure 3A:
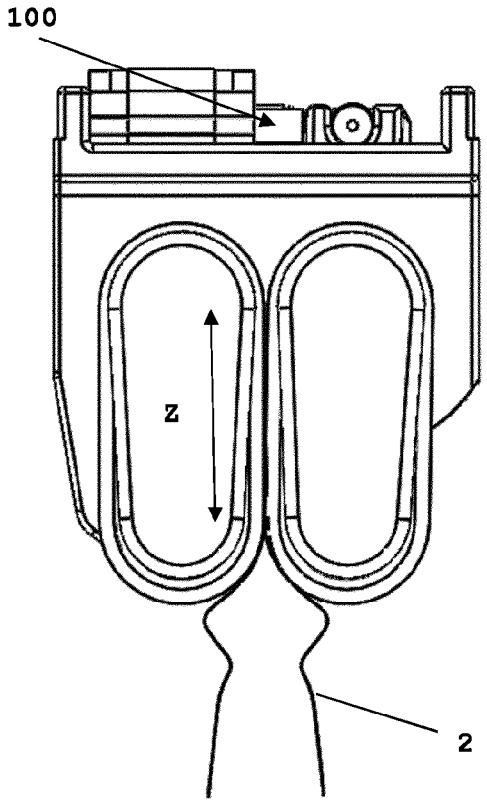
FIGS. 3*a* and 3*b* show the gripper head of the present invention; shown in FIGS. 2*a*-2*c* turned into two positions by an actuator that is shown and was not visible in FIGS. 2*a*-2*c*, seen in a front view and in a front perspective view, respectively.

Generally, a second part 33 of the gripper head 1 carries a second roller 18' of the second pair of rollers 8', 18' and is pivotally mounted to the first part 11 so it may be turned relative to the first part 11 about the rotation axis 35 of the first (upper) roller 8' of the second pair of rollers 8', 18', to and from a cloth nipping position shown in FIG. 2*d* and similarly in FIG. 3*a*, in which cloth nipping position the second roller 18' of the second pair of rollers 8', 18' and a second roller 18 of the first pair of rollers 8, 18 are close to each other with the conveyor belts 6, 6' defining between them the nipping zone Z. When turned away from the cloth nipping position, i.e., to what may be referred to as an open configuration of the gripper head 1 as shown in FIG. 2*a-c* and 3*b*, catching a piece of cloth 2 in the pile 4 to draw in into what becomes the nipping zone Z once the second part 33 has been turned to its cloth nipping position, is made more reliable, and may even be necessary where the pieces of cloth 2 are relatively stiff.

In the slightly modified version of the gripper head 1 shown in FIGS. 2*a*-2*c*, a spring 34 is arranged to bias the second part 33 towards the cloth nipping position, see FIG. 2*d*. This embodiment involves the advantage that the second part 33 may deflect slightly away from the nipping position at the time a piece of cloth 2 is picked up, wherever necessary.

An actuator 100, such as—without limitation—a hydraulic actuator, a pneumatic actuator or a motor, connected with the first part 11 is connected also with the second part 33 at an extension of the latter above the level of the upper roller 8'. The actuator 100 is configured for turning the second part 33 relative to the first part 11 about the axis 35 of rotation of the upper roller 8', and for holding the second part 33 in a selected position, such as in the cloth nipping position shown in FIGS. 2*d* and 3*a*, wherein a portion of a piece of cloth may be held sandwiched between the two conveyor belts 6, 6' in the nipping zone Z. FIGS. 2*a-c* and 3*b* show the second part 33 turned away from the nipping position by the actuator 100. A controller C shown in FIG. 2*d* acts to control the actuator 100.

In a first mode of operation the gripper head 1 is configured such that the second part 33 in the aforementioned nipping position shown in FIG. 3*a* applies a first, relatively low clamping force onto a piece of cloth 2 held by the gripper head 1. This low force may preferably be applied while the piece of cloth 2 is a) being drawn into the nipping zone Z by the moving conveyor belts 6, 6', b) being held in the nipping zone Z, and c) being moved to the delivery position by the robotic arm 26. This would be the case where the piece of cloth 2 is deemed to be made from a delicate material, requiring handling using a low clamping pressure. The first, low clamping force may be applied by the actuator 100, by the aforementioned spring 34, or by the actuator 100 and the spring 34 acting together.

In another mode of operation the actuator 100 may be operated such that the second part 33, upon selection of this other mode, applies a selected second and higher clamping force, eg. either i) only after a piece of cloth 2 has been drawn fully into the nipping zone Z and until the piece of cloth 2 is released from the gripper head 2 in its delivery position, or ii) from the start of the process of drawing the piece of cloth 2 into the nipping zone Z until the piece of cloth 2 is finally released from the gripper head 2 in its delivery position; in the latter case a controller C of the gripper head 1 provides for the application of a second, higher clamping force in due time. The second, higher clamping force may be preferably applied by the actuator 100. This mode of operation may preferably be selected when a heavy piece of cloth of a non-delicate nature is to be drawn out of the pile 4.

Where in an alternative embodiment the aforementioned spring 34 provides the higher clamping force, the actuator 100 is configured to reduce that clamping force when the gripper 1 is to operate in the aforementioned first mode.

Figure 3B:
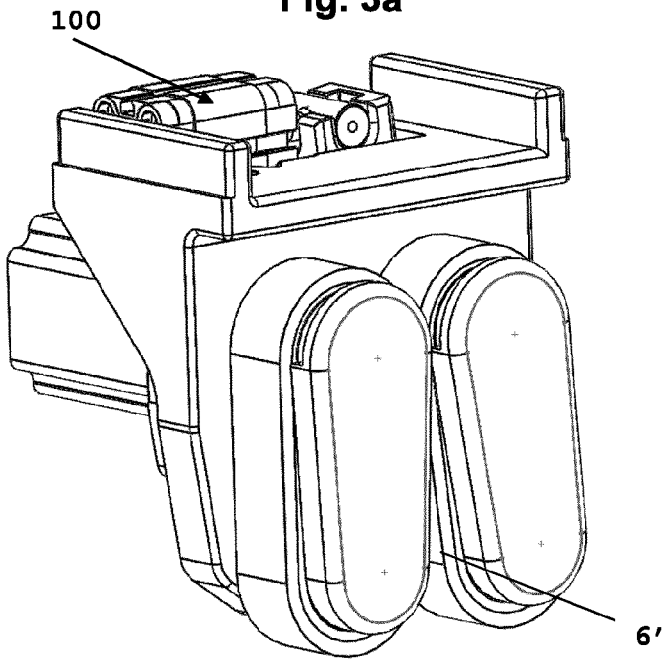

The controller C may be connected with sensors for recognising the type of cloth in a pile 4, and—hence—for determining if the gripper head 1 should be operated in the first mode or in the second mode. Alternatively, an operator may manually select when the gripper head 1 is to operate in one or the other mode.

Where desired, the controller C may be configured to control the actuator 100 to turn the second part 33 away from the nipping position, as shown in FIGS. 2*a* and 3*b*, which may be desirable at the beginning of the phase where cloth is drawn in between the two conveyor belts 6, 6'.

It is noted that the respective clamping forces may be varied as desired, using the controller to appropriately set the actuator and/or by replacing any spring as mentioned.

The invention claimed is:

1. A gripper head adapted to grip, hold, and release a piece of cloth, comprising:

a first part carrying a first conveyor belt and a second belt, wherein between said first conveyor belt and said second conveyor belt is a nipping zone into which a portion of a piece of cloth in contact with said first conveyor belt and said second conveyor belt is configured to be drawn when said first conveyor belt and said second conveyor belt move in a first direction;

said first conveyor belt being trailed around a first pair of rotatable rollers and said second conveyor belt being trailed about a second pair of rotatable rollers;

at least one drive configured to: i) move said first conveyor belt and said second conveyor belt in said first direction, ii) temporarily stop moving said first conveyor belt and said second conveyor belt when said nipping zone is filled by said portion of said piece of cloth, and iii) move said first conveyor belt and said second conveyor belt in an opposite second direction; and a second part carrying a second roller of said second pair of rollers and being pivotally mounted to said first part for turning relative to said first part about an axis of rotation of a first roller of said second pair of rollers, to and from a cloth nipping position, in which cloth nipping position the nipping zone is defined between said first conveyor belt and said second conveyor belt;

said gripper head being configured to apply in said cloth nipping position a first clamping force on said piece of cloth in said nipping zone;

an actuator connected with said second part and configured for turning said second part relative to said first part; and a controller connected with said actuator and configured to control said actuator for said second part to apply in said cloth nipping position a second, higher clamping force on said piece of cloth in said nipping zone.

2. The gripper head of claim 1, further comprising a spring biasing said second part towards said cloth nipping position.

3. The gripper head according to claim 2, wherein said spring provides said first clamping force.

4. The gripper head according to claim 2, said controller configured to control said actuator to apply together with said spring said first clamping force.

5. The gripper head according to claim 1, said controller configured to control said actuator to apply said first clamping force on said piece of cloth while being drawn into said nipping zone.

6. The gripper head according to claim 1, said controller configured to control said actuator to turn said second part from said cloth nipping position to a position with said first conveyor belt and said second conveyor belt spaced apart from each other, for catching said piece of cloth in a pile and to draw in into what becomes the nipping zone once said second part has turned to its cloth nipping position.

7. The gripper head according to claim 1, wherein a first roller of said first pair of rollers and said first roller of said second pair of rollers being interconnected by toothed wheels for rotating said first roller of said first pair of rollers and said first roller of said second pair of rollers about a respective rotation axis, at least one of said toothed wheels being driven by a motor for clockwise and counter-clockwise rotation.

8. The gripper head of claim 1, wherein said actuator is selected from the group consisting of a hydraulic actuator, a pneumatic actuator, and a motor.

9. A gripper comprising:

a gripper head comprising:

a first part carrying a first conveyor belt and a second belt, wherein between said first conveyor belt and said second conveyor belt is a nipping zone into which a portion of a piece of cloth in contact with said first conveyor belt and said second conveyor belt is configured to be drawn when said first conveyor belt and said second conveyor belt move in a first direction;

said first conveyor belt being trailed around a first pair of rotatable rollers and said second conveyor belt being trailed about a second pair of rotatable rollers;

at least one drive configured to: i) move said first conveyor belt and said second conveyor belt in said first direction, ii) temporarily stop moving said first conveyor belt and said second conveyor belt when said nipping zone is filled by said portion of said piece of cloth, and iii) move said first conveyor belt and said second conveyor belt in an opposite second direction; and a second part carrying a second roller of said second pair of rollers and being pivotally mounted to said first part for turning relative to said first part about an axis of rotation of a first roller of said second pair of rollers, to and from a cloth nipping position, in which cloth nipping position the nipping zone is defined between said first conveyor belt and said second conveyor belt;

said gripper head being configured to apply in said cloth nipping position a first clamping force on said piece of cloth in said nipping zone;

an actuator connected with said second part and configured for turning said second part relative to said first part; and a controller connected with said actuator and configured to control said actuator for said second part to apply in said cloth nipping position a second, higher clamping force on said piece of cloth in said nipping zone; and a robotic arm, wherein said gripper head is mounded to said robotic arm and said robotic arm moves said gripper head around in a 3-dimensional space.

10. The gripper of claim 9, wherein said actuator is selected from the group consisting of a hydraulic actuator, a pneumatic actuator, and a motor.

11. A method of operating a gripper head adapted to grip, hold, and release a piece of cloth, the gripper head comprising:

a first part carrying a first conveyor belt and a second belt, wherein between said first conveyor belt and said second conveyor belt is a nipping zone into which a portion of a piece of cloth in contact with said first conveyor belt and said second conveyor belt is configured to be drawn when said first conveyor belt and said second conveyor belt move in a first direction;

said first conveyor belt being trailed around a first pair of rotatable rollers and said second conveyor belt being trailed about a second pair of rotatable rollers;

at least one drive configured to: i) move said first conveyor belt and said second conveyor belt in said first direction, ii) temporarily stop moving said first conveyor belt and said second conveyor belt when said nipping zone is filled by said portion of said piece of cloth, and iii) move said first conveyor belt and said second conveyor belt in an opposite second direction; and a second part carrying a second roller of said second pair of rollers and being pivotally mounted to said first part for turning relative to said first part about an axis of rotation of a first roller of said second pair of rollers, to and from a cloth nipping position, wherein a nipping zone is defined between said first conveyor belt and said second conveyor belt;

said second part configured to apply in said cloth nipping position a first clamping force on said piece of cloth in a process of being drawn into said nipping zone by said first conveyor belt and said second conveyor belt moving in said first direction; and an actuator connected with said second part and configured for turning and holding said second part in said cloth nipping position;

the method comprising:

activating said actuator to apply a first clamping force on said piece of cloth in said nipping zone and/or to apply a second, higher clamping force on said piece of cloth in said nipping zone.

12. The method of claim 11 comprising turning by said actuator said second part into said cloth nipping position before or after said piece of cloth is drawn into said nipping zone.

13. The method of claim 12, wherein said second part is turned away from said cloth nipping position into a position with said first conveyor belt and said second conveyor belt are spaced apart from each other, for catching said piece of cloth in a cloth pile, to draw said piece of cloth into what becomes said nipping zone once said second part has been turned to said cloth nipping position.

14. The method of claim 12, wherein said gripper head is mounted to an end of a robotic arm for moving said gripper head around in a 3-dimensional space, wherein said method further comprises:

i) determining a size of said piece of cloth held by said gripper head, or to be held by said gripper head; and ii) then moving said robotic arm with said piece of cloth to an elevated position above a gripper to which said piece of cloth is to be transferred, said elevated position being higher for large pieces of cloth than for smaller pieces of cloth.

15. The method of claim 11, wherein said second part is turned away from said cloth nipping position into a position with said first conveyor belt and said second conveyor belt are spaced apart from each other, for catching said piece of cloth in a cloth pile, to draw said piece of cloth into what becomes said nipping zone once said second part has been turned to said cloth nipping position.

16. The method of claim 15, wherein said gripper head is mounted to an end of a robotic arm for moving said gripper head around in a 3-dimensional space, wherein said method further comprises:

i) determining a size of said piece of cloth held by said gripper head, or to be held by said gripper head; and ii) then moving said robotic arm with said piece of cloth to an elevated position above a gripper to which said piece of cloth is to be transferred, said elevated position being higher for large pieces of cloth than for smaller pieces of cloth.

17. The method of claim 11, wherein said gripper head is mounted to an end of a robotic arm for moving said gripper head around in a 3-dimensional space, wherein said method further comprises:

i) determining a size of said piece of cloth held by said gripper head, or to be held by said gripper head; and ii) then moving said robotic arm with said piece of cloth to an elevated position above a gripper to which said piece of cloth is to be transferred, said elevated position being higher for large pieces of cloth than for smaller pieces of cloth.

18. The method of claim 11, wherein said actuator is selected from the group consisting of a hydraulic actuator, a pneumatic actuator, and a motor.

* * * * *